US005675977A

United States Patent [19]

Prosser

[11] Patent Number: 5,675,977

[45] Date of Patent: Oct. 14, 1997

[54] CRYOGENIC RECTIFICATION SYSTEM WITH KETTLE LIQUID COLUMN

[75] Inventor: Neil Mark Prosser, Lockport, N.Y.

[73] Assignee: Praxair Technology, Inc., Danbury, Conn.

[21] Appl. No.: 745,149

[22] Filed: Nov. 7, 1996

[51] Int. Cl.[6] ..... F25J 1/00

[52] U.S. Cl. ..... 62/646; 62/652

[58] Field of Search ..... 62/646, 654

[56] References Cited

U.S. PATENT DOCUMENTS

| | | | |
|---|---|---|---|
| 4,254,629 | 3/1981 | Olszewski | 62/13 |
| 5,231,837 | 8/1993 | Ha | 62/24 |
| 5,263,327 | 11/1993 | Drnevich et al. | 62/24 |
| 5,265,429 | 11/1993 | Dray | 62/646 |
| 5,341,646 | 8/1994 | Agrawal et al. | 62/25 |
| 5,392,609 | 2/1995 | Girault | 62/654 |
| 5,438,835 | 8/1995 | Rathbone | 62/25 |
| 5,440,884 | 8/1995 | Bonaquist et al. | 62/646 |
| 5,463,871 | 11/1995 | Cheung | 62/646 |
| 5,467,602 | 11/1995 | Paolino et al. | 62/654 |
| 5,469,710 | 11/1995 | Howard et al. | 62/646 |
| 5,546,767 | 8/1996 | Dray et al. | 62/654 |

*Primary Examiner*—Ronald C. Capossela
*Attorney, Agent, or Firm*—Stanley Ktorides

[57] ABSTRACT

A cryogenic rectification system for producing oxygen and nitrogen employing a kettle liquid column which processes oxygen-enriched kettle liquid from a higher pressure column and which is reboiled by a fluid taken from below the top of the higher pressure column.

10 Claims, 1 Drawing Sheet

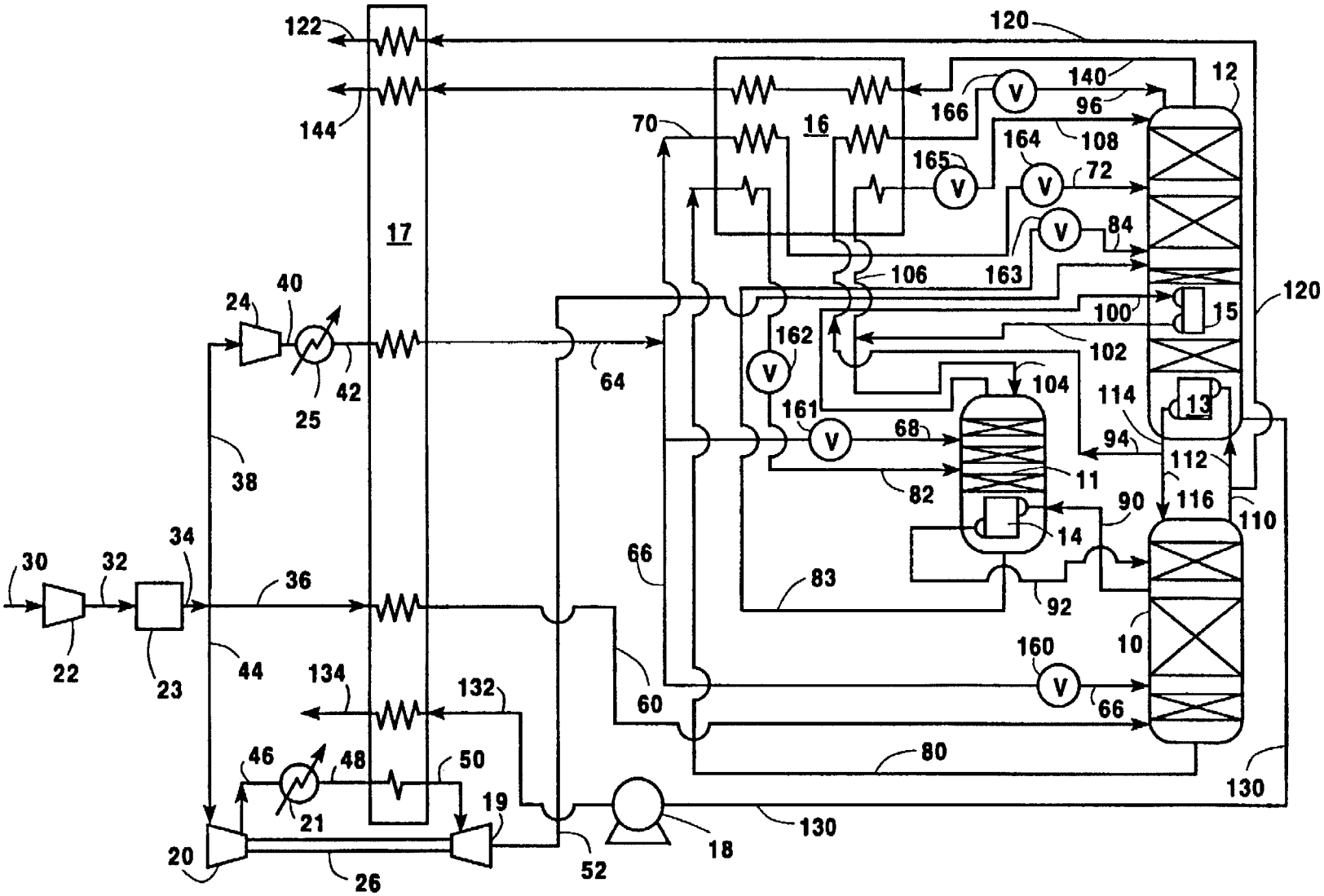
120
12
15
13
110
112
116
130
140
96
108
72
84
100
102
114
94
90
10
66
120
164
163
104
11
14
92
160
166
165
106
68
82
80
16
162
161
83
130
18
70
66
60
64
52
132
19
50
17
122
144
42
25
40
24
38
36
134
48
21
26
46
44
34
23
20
32
22
30

CRYOGENIC RECTIFICATION SYSTEM WITH KETTLE LIQUID COLUMN

TECHNICAL FIELD

This invention relates generally to the cryogenic rectification of feed air and, more particularly, to the cryogenic rectification of feed air to produce oxygen and nitrogen.

BACKGROUND ART

The cryogenic rectification of feed air typically is carried out with a double column system wherein an initial separation is carried out in a higher pressure column and the final separation is carried out in a lower pressure column. The products are produced in the lower pressure column at slightly above ambient pressure.

In some instances one or both of the oxygen and nitrogen products are desired at elevated pressure. Particularly when nitrogen is withdrawn from the system at an elevated pressure, there may not be sufficient reflux available to operate the columns efficiently.

Accordingly, it is an object of this invention to provide a cryogenic rectification system for producing oxygen and nitrogen which can operate efficiently even when one or both of the products are produced at an elevated pressure.

SUMMARY OF THE INVENTION

The above and other objects, which will become apparent to those skilled in the art upon a reading of this disclosure, are attained by the present invention, one aspect of which is:

A cryogenic rectification method for producing oxygen and nitrogen comprising:

(A) passing feed air into a higher pressure column and separating the feed air within the higher pressure column by cryogenic rectification into oxygen-enriched kettle liquid and nitrogen-enriched top fluid;

(B) passing oxygen-enriched kettle liquid into a kettle liquid column and producing intermediate vapor and intermediate liquid by cryogenic rectification within the kettle liquid column;

(C) passing a vapor stream taken from below the top of the higher pressure column in indirect heat exchange with intermediate liquid to produce higher pressure liquid and passing higher pressure liquid into the higher pressure column;

(D) passing fluid from the kettle liquid column into a lower pressure column and producing nitrogen-richer fluid and oxygen-richer fluid by cryogenic rectification within the lower pressure column; and (E) recovering at least some of the oxygen-richer fluid as product oxygen and recovering at least some of at least one of the intermediate vapor, the nitrogen-enriched top fluid and the nitrogen-richer fluid as product nitrogen.

Another aspect of the invention is:

Cryogenic rectification apparatus for producing oxygen and nitrogen comprising:

(A) a first column, a second column, and means for passing feed air into the first column;

(B) a kettle liquid column having a bottom reboiler, and means for passing fluid from the lower portion of the first column into the kettle liquid column;

(C) means for passing fluid from below the top of the first column into the kettle liquid column bottom reboiler, and means for passing fluid from the kettle liquid column bottom reboiler into the first column;

(D) means for passing fluid from the kettle liquid column into the second column; and (E) means for recovering fluid from the lower portion of the second column, and means for recovering fluid from the upper portion of at least one of the first column, the second column and the kettle liquid column.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element height equivalent to one theoretical plate (HETP).

As used herein, the term "feed air" means a mixture comprising primarily oxygen and nitrogen, such as ambient air.

As used herein, the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. M. Chilton, McGraw-Hill Book Company, New York, Section 13, *The Continuous Distillation Process*. The term, double column, is used to mean a higher pressure column having its upper portion in heat exchange relation with the lower portion of a lower pressure column. A further discussion of double columns appears in Ruheman "The Separation of Gases", Oxford University Press, 1949, Chapter VII, Commercial Air Separation.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K.).

As used herein, the term "indirect heat exchange" means the bringing of two fluid streams into heat exchange relation without any physical contact or intermixing of the fluids with each other.

As used herein, the term "reboiler" means a heat exchange device that generates column upflow vapor from column liquid.

As used herein, the terms "turboexpansion" and "turboexpander" mean respectively method and apparatus for the flow of high pressure gas through a turbine to reduce the pressure and the temperature of the gas thereby generating refrigeration.

As used herein, the terms "upper portion" and "lower portion" mean those sections of a column respectively above and below the mid point of the column.

As used herein, the term "bottom" when referring to a column means that section of the column below the column mass transfer internals, i.e. trays or packing.

As used herein, the term "bottom reboiler" means a reboiler that boils liquid from the bottom of a column. A bottom reboiler may be located within or outside of the column.

As used herein, the term "intermediate reboiler" means a reboiler that boils liquid from above the bottom of a column. An intermediate reboiler may be located within or outside of the column.

As used herein, the term "top" when referring to a column means that section of the column above the column mass transfer internals, i.e., trays or packing.

As used herein, the term "kettle liquid column" means a column which processes a fluid taken from the lower portion, preferably the bottom, of another column.

BRIEF DESCRIPTION OF THE DRAWING

The sole FIGURE is a schematic representation of one preferred embodiment of the invention.

DETAILED DESCRIPTION

The invention employs a kettle liquid column to produce additional liquid reflux enabling the efficient production of elevated pressure product. The kettle liquid column is driven by fluid taken from below the top of the higher pressure column. Such fluid has an oxygen concentration and consequently a temperature which exceeds that of fluid at the top of the higher pressure column. This higher temperature fluid causes the temperature at the bottom of the kettle liquid column to exceed that at the bottom of the lower pressure column. The higher temperature of the fluid also enables increased flow for the higher pressure fluid causing high vapor upflow and liquid downflow within the kettle liquid column. This results in increased production of reflux liquid compared with conventional systems enabling improved product recovery and/or increased average product nitrogen pressure.

The invention will be described in detail with reference to the FIGURE. Referring now to the FIGURE, feed air 30 is compressed, generally to a pressure within the range of from 65 to 325 pounds per square inch absolute (psia), by passage through compressor 22. Compressed feed air 32 is cleaned of high boiling impurities, such as carbon dioxide and water vapor, by passage through purifier 23, and resulting cleaned, compressed feed air is passed into the higher pressure column. The embodiment illustrated in the FIGURE is a preferred embodiment wherein only a portion of the cleaned, compressed feed air is passed into the higher pressure column. Referring back to the FIGURE, cleaned, compressed feed air 34 is divided into three portions 36, 38 and 44. First portion 36, comprising at least 60 percent and generally from about 60 to 75.5 percent of feed air 34 is cooled by passage through main heat exchanger 17 by indirect heat exchange with return streams. Resulting feed air stream 60 is passed into first or higher pressure column 10 which is operating at a pressure generally within the range of from 60 to 320 psia.

Second feed air portion 38, when employed, generally comprises from about 24 to 34 percent of stream 34. This stream is used to vaporize compressed liquid oxygen when elevated pressure oxygen product is desired. Stream 38 is compressed by passage through compressor 24 to a pressure generally within the range of from 75 to 2500 psia, preferably 125 to 1300 psia, and resulting pressurized stream 40 is cooled to near ambient temperature by passage through cooler 25. Resulting stream 42 is passed through main heat exchanger 17 wherein it is condensed. Resulting liquid in stream 64 is passed into at least one or, as illustrated in the FIGURE, into all three of the columns employed in the practice of this invention although stream 68, the portion of stream 64 feeding the kettle liquid column is optional. A first liquid portion 70 is subcooled by partial traverse of heat exchanger 16, passed through valve 164 and passed as stream 72 into second or lower pressure column 12. Column 12 is the lower pressure column of a double column system which also includes higher pressure column 10 and is operating at a pressure less than that of higher pressure column 10 and generally within the range of from about 16 to 125 psia.

The remainder of stream 64 is passed into higher pressure column 10 and optionally into kettle liquid column 11 which is operating at a pressure between those of the higher and lower pressure columns and generally within the range of from about 35 to 230 psia. Referring to the FIGURE, optional portion 68 of liquid stream 64 is passed through valve 161 and into kettle liquid column 11, and portion 66 of liquid stream 64 is passed through valve 160 and into higher pressure column 10.

Third feed air portion 44, when employed, generally comprises from about 0.5 to 6 percent of feed air stream 34. Stream 44 is compressed to a pressure generally within the range of from 100 to 550 psia by passage through compressor 20. Resulting compressed stream 46 is cooled to near ambient temperature by passage through cooler 21 and resulting stream 48 is cooled by partial traverse of main heat exchanger 17. Resulting stream 50 is turboexpanded through turboexpander 19 to generate refrigeration and resulting turboexpanded stream 52 is passed into lower pressure column 12. Energy generated by turboexpander 19 is used to drive compressor 20 through shaft 26.

Within higher pressure column 10 the feed air passed into the column is separated by cryogenic rectification into oxygen-enriched kettle liquid and nitrogen-enriched top fluid. Nitrogen-enriched top fluid is withdrawn as vapor stream 110 from the top of higher pressure column 10. If desired, as illustrated in the FIGURE, a portion 120 of stream 110 may be warmed by passage through main heat exchanger 17 and recovered as product high pressure nitrogen 122 having a nitrogen concentration generally of at least 97 mole percent. If desired, a portion of stream 120 may be withdrawn after partial traverse of main heat exchanger 17, turboexpanded to generate refrigeration and returned to the columns.

Stream 112, which comprises the remainder of nitrogen-enriched top fluid stream 110, is passed into bottom reboiler 13 of lower pressure column 12 wherein it is condensed by indirect heat exchange with boiling lower pressure column bottom liquid. Resulting condensed nitrogen-enriched top fluid 114 is passed as reflux into both lower pressure column 12 and higher pressure column 10. A first portion 94 of stream 114 is subcooled by partial traverse of heat exchanger 16, expanded through valve 166 and passed as stream 96 into the upper portion of lower pressure column 12. A second portion 116 of stream 114 is passed into the upper portion of higher pressure column 10. If desired, a portion of liquid nitrogen-enriched top fluid 114 may also be passed into the upper portion of kettle liquid column 11 as reflux.

Oxygen-enriched kettle liquid, having an oxygen concentration generally within the range of from 29 to 42 mole percent is withdrawn from the lower portion of higher pressure column 10 in stream 80, subcooled by partial traversal of heat exchanger 16, reduced in pressure by passage through valve 162 and passed as stream 82 into kettle liquid column 11.

Within kettle liquid column 11, the feeds into that column are separated by cryogenic rectification into intermediate vapor and intermediate liquid. Intermediate liquid, having an oxygen concentration generally within the range of from 38 to 51 mole percent, is withdrawn from the lower portion of kettle liquid column 11 in stream 83 passed through valve 163 and then passed into lower pressure column 12 as stream 84. Intermediate vapor, having a nitrogen concentration of at least 97 mole percent, is withdrawn from the upper portion of kettle liquid column 11 as stream 100 and passed into intermediate reboiler 15 of lower pressure column 12. Resulting nitrogen-containing liquid 102 is divided into stream 104, which is passed into the upper portion of kettle liquid column 11 as reflux, and into stream 106 which is subcooled by partial traverse of heat exchanger 16, expanded through valve 165 and passed as additional reflux stream 108 into the upper portion of lower pressure column 12. If desired, a portion of intermediate vapor 100 may be recovered as nitrogen vapor product.

Kettle liquid column 11 is driven by a high pressure vapor stream 90 taken from below the top of higher pressure column 10. Stream 90 has an oxygen concentration which exceeds that of the nitrogen-enriched top fluid and which is generally within the range of from 0.5 to 8 mole percent. Stream 90 is taken from a point from 1 to 15 equilibrium stages, preferably 4 to 15 equilibrium stages, below the top of higher pressure column 10. If the stream which is passed into the kettle liquid column bottom reboiler were to be taken from above the optimal point defined by this range, the necessary added reflux would not be produced, and if it were to be taken from below this range, product recovery is compromised. Stream 90 is passed into bottom reboiler 14 of kettle liquid column 11 wherein it is condensed by indirect heat exchange with kettle liquid column bottom liquid. Resulting liquid stream 92 is passed back into higher pressure column 10 at a point at the same level or above the level from which stream 90 is withdrawn from higher pressure column 10.

Because stream 90 has a higher oxygen concentration and therefor higher temperature than the nitrogen-enriched top fluid which reboils the bottom of lower pressure column 12, the bottom of kettle liquid column 11, which is reboiled by stream 90, has a higher temperature, generally by from 0.5° to 2.0° K., than the bottom of lower pressure column 12. This higher temperature enables the flow of stream 90 to be increased and results in higher vapor upflow and liquid downflow within kettle liquid column 11. This, in turn, increases the flow of intermediate vapor withdrawn from column 11 which results in increased production of additional reflux which can be passed into lower pressure column 12 in stream 108. The additional reflux enables increased product recovery, or the ability to increase the flow of the nitrogen-enriched top fluid or the intermediate vapor, or the ability to increase the pressure of the system, enabling a savings in compression power.

Within lower pressure column 12 the various feeds into that column are separated by cryogenic rectification into nitrogen-richer fluid and oxygen-richer fluid. Oxygen-richer fluid, having an oxygen concentration generally within the range of from 70 to 99.5 mole percent, preferably within the range of from 80 to 98 mole percent, is withdrawn from the lower portion of lower pressure column 12 as stream 130 and recovered as product oxygen. If desired, as illustrated in the FIGURE, stream 130 may be increased in pressure, generally to a pressure within the range of from 30 to 2000 psia, preferably 50 to 1300 psia, by passage through pump 18. Pressurized stream 132 is then vaporized by passage through main heat exchanger 17 and recovered as oxygen product stream 134.

Nitrogen-richer fluid, having a nitrogen concentration generally of at least 97 mole percent, is withdrawn from the upper portion of lower pressure column 12 as stream 140, warmed by passage through heat exchanger 16 and main heat exchanger 17 and withdrawn from the system as stream 144. If desired, some or all of stream 144 may be recovered as lower pressure nitrogen product. If desired, a portion of stream 140 may be withdrawn after partial traverse of main heat exchanger 17 and turboexpanded to generate refrigeration. The resulting turboexpanded stream may then be passed through main heat exchanger 17 wherein the refrigeration is passed by indirect heat exchange into the entering feed streams.

Now, with the practice of this invention, one can effectively produce both oxygen and nitrogen product, especially at elevated pressures, without encountering reflux starved column conditions. Although the invention has been described in detail with reference to a preferred embodiment of the invention, those skilled in the art will recognize that there are other embodiments of the invention within the spirit and the scope of the claims. For example, the intermediate vapor from the kettle liquid column may be condensed by indirect heat exchange with liquid from the kettle liquid column rather than with fluid from the lower pressure column.

I claim:

1. A cryogenic rectification method for producing oxygen and nitrogen comprising:

(A) passing feed air into a higher pressure column and separating the feed air within the higher pressure column by cryogenic rectification into oxygen-enriched kettle liquid and nitrogen-enriched top fluid;

(B) passing oxygen-enriched kettle liquid into a kettle liquid column and producing intermediate vapor and intermediate liquid by cryogenic rectification within the kettle liquid column;

(C) passing a vapor stream taken from below the top of the higher pressure column in indirect heat exchange with intermediate liquid to produce higher pressure liquid and passing higher pressure liquid into the higher pressure column;

(D) passing fluid from the kettle liquid column into a lower pressure column and producing nitrogen-richer fluid and oxygen-richer fluid by cryogenic rectification within the lower pressure column; and (E) recovering at least some of the oxygen-richer fluid as product oxygen and recovering at least some of at least one of the intermediate vapor, the nitrogen-enriched top fluid and the nitrogen-richer fluid as product nitrogen.

2. The method of claim 1 wherein the vapor stream is taken from 1 to 15 equilibrium stages below the top of the higher pressure column.

3. The method of claim 1 wherein the higher pressure liquid is passed into the higher pressure column at a level at or above the level from which the vapor stream is taken from the higher pressure column.

4. The method of claim 1 wherein intermediate vapor is withdrawn from the upper part of the kettle liquid column, condensed, and the resulting liquid passed into both the lower pressure column and the kettle liquid column.

5. The method of claim 4 wherein the intermediate vapor is condensed by indirect heat exchange with fluid from at least one of the lower pressure column and the kettle liquid column.

6. Cryogenic rectification apparatus for producing oxygen and nitrogen comprising:

(A) a first column, a second column, and means for passing feed air into the first column;

(B) a kettle liquid column having a bottom reboiler, and means for passing fluid from the lower portion of the first column into the kettle liquid column;

(C) means for passing fluid from below the top of the first column into the kettle liquid column bottom reboiler, and means for passing fluid from the kettle liquid column bottom reboiler into the first column;

(D) means for passing fluid from the kettle liquid column into the second column; and (E) means for recovering fluid from the lower portion of the second column, and means for recovering fluid from the upper portion of at least one of the first column, the second column and the kettle liquid column.

7. The apparatus of claim 6 wherein the means for passing fluid from below the top of the first column into the kettle liquid column bottom reboiler communicates with the first column at a level from 1 to 15 equilibrium stages below the top of the first column.

8. The apparatus of claim 6 wherein the means for passing fluid from the kettle liquid column bottom reboiler into the first column communicates with the first column at or above the level from which vapor is passed from the first column into the kettle liquid column bottom reboiler.

9. The apparatus of claim 6 wherein the means for passing fluid from the kettle liquid column into the second column comprises means for passing fluid from the upper portion of the kettle liquid column into the second column and means for passing fluid from the lower portion of the kettle liquid column into the second column.

10. The apparatus of claim 6 further comprising an intermediate reboiler for the second column, means for passing fluid from the upper portion of the kettle liquid column into the intermediate reboiler, and means for passing fluid from the intermediate reboiler into the upper portion of the second column.

* * * * *